US008459746B2

(12) United States Patent
Lai

(10) Patent No.: US 8,459,746 B2
(45) Date of Patent: Jun. 11, 2013

(54) ADJUSTABLE ARMREST STRUCTURE FOR A CHAIR

(76) Inventor: Yu-Shan Lai, Chiayi (TW)

( * ) Notice: Subject to any disclaimer, the term of this patent is extended or adjusted under 35 U.S.C. 154(b) by 409 days.

(21) Appl. No.: 12/778,527

(22) Filed: May 12, 2010

(65) Prior Publication Data

US 2011/0278898 A1 Nov. 17, 2011

(51) Int. Cl.
*A47C 7/54* (2006.01)

(52) U.S. Cl.
USPC ..... 297/411.37; 297/115; 297/411.27

(58) Field of Classification Search
USPC ..... 297/411.37, 411.36, 411.26, 411.27, 297/115, 353, 410
See application file for complete search history.

(56) References Cited

U.S. PATENT DOCUMENTS 4,221,430 A * 9/1980 Frobose ..... 297/353
5,338,133 A * 8/1994 Tornero ..... 403/321
5,586,811 A * 12/1996 Tornero ..... 297/411.36
5,660,442 A * 8/1997 Tornero ..... 297/411.36
6,062,646 A * 5/2000 Bock ..... 297/411.36
6,155,643 A * 12/2000 Gorgi et al. ..... 297/353
6,296,313 B1 * 10/2001 Wu ..... 297/411.35
6,572,195 B1 * 6/2003 Lee ..... 297/411.37
7,080,885 B2 * 7/2006 Bain et al. ..... 297/354.1
7,243,997 B1 * 7/2007 Tornero ..... 297/411.37
7,296,855 B1 * 11/2007 Link ..... 297/353
7,559,609 B2 * 7/2009 Tsai ..... 297/411.35
7,780,237 B2 * 8/2010 Chen et al. ..... 297/397
8,104,838 B2 * 1/2012 Tsai ..... 297/411.37
2003/0151282 A1 * 8/2003 Williams et al. ..... 297/250.1
2007/0284928 A1 * 12/2007 Pozzi ..... 297/391
2008/0309140 A1 * 12/2008 Ho ..... 297/411.36
2010/0038949 A1 * 2/2010 Liao ..... 297/408
2011/0095590 A1 * 4/2011 Pozzi ..... 297/404

* cited by examiner

*Primary Examiner* — David Dunn
*Assistant Examiner* — David E Allred
(74) *Attorney, Agent, or Firm* — Alan Kamrath; Kamrath IP Lawfirm, P.A.

(57) ABSTRACT

An adjustable armrest structure for a chair is an adjusting assembly fixed to bottom ends of two armrests on two sides of the chair and includes a body, two side rails, and a movable member. The body includes a guiding slot formed on a bottom end thereof to fit a screwing element and to engage with the movable member. The guiding slot of the body includes a plurality of arcuate recesses arranged around the two sides thereof to fit two projections fixed on two sides of a guide member respectively. An actuating member includes a bore disposed thereon and is fixed to the guide member. The screwing element is inserted through the bore of the actuating member and an orifice of the guide member. A screw segment of the screwing element is screwed with the aperture of the movable member.

3 Claims, 4 Drawing Sheets

ADJUSTABLE ARMREST STRUCTURE FOR A CHAIR

BACKGROUND OF THE INVENTION

1. Field of the Invention

The present invention relates to an adjustable armrest structure for a chair being an adjusting assembly fixed to bottom ends of two armrests on two sides of the chair operated easily to adjust a distance between the armrests after sitting on the chair to abut the user's hands against the armrests comfortably.

2. Description of the Prior Art

As in FIGS. 1 and 1-1, a conventional adjusting assembly 50 fixed on bottom ends of two armrests of a chair contains a body 10 disposed on a top end of a support of the armrest of the chair, two side rails 20 fitted to and engaged with two sides of the body 10, a movable member 30 fitted between the side rails 20, and a screwing element 40 inserted through a slot 101 formed on one side surface of the body 10. The screwing element 40 includes a screw segment 401 screwed with an aperture 301 of the movable member 30 correspondingly, so that when the screwing element 40 moves along the slot 101 of the body 10 horizontally, the movable member 30 is actuated to move simultaneously. One side of the movable member 30 is connected with the armrests (not shown) based on a desired width and shape. Hence, the movable member 30 is guided to move to adjust the armrests. Thereby, the armrests move inward or outward to obtain a preferred distance between the armrests after the user sits on the chair.

However, after the adjusting assembly of the armrests is adjusted to a desired direction, if the user's hands move inward or push outward, the direction of the armrests is changed and has to be adjusted again.

The present invention has arisen to mitigate and/or obviate the afore-described disadvantages.

SUMMARY OF THE INVENTION

The primary object of the present invention is to provide an adjustable armrest structure for a chair that can adjust a distance between the armrests easily and the armrest can not be moved by the user's hands. Hence, the hands can abut against the armrests comfortably.

To obtain the above objectives, an adjustable armrest structure for a chair provided by the present invention is an adjusting assembly fixed to bottom ends of two armrests on two sides of the chair and including a body, two side rails to be fitted to and engaged with the body, and a movable member fitted between the side rails. The body includes a guiding slot formed on a bottom end thereof to fit a screwing element and to engage with the movable member.

The guiding slot of the body includes a plurality of arcuate recesses arranged around the two sides thereof to fit two projections fixed on two sides of a guide member respectively. An actuating member includes a bore disposed thereon and is fixed to the guide member, so that the screwing element is inserted through the bore of the actuating member and an orifice of the guide member. A screw segment of the screwing element is screwed with the aperture of the movable member.

The guide member is integrally made of plastic material and includes at least one hollow spaced room formed thereon, so that the guide member is actuated to move along the arcuate recesses resiliently.

BRIEF DESCRIPTION OF THE DRAWINGS

FIG. 1-1 is a perspective view showing the cross section of the assembly of the conventional adjusting assembly of the two armrests for the chair;

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
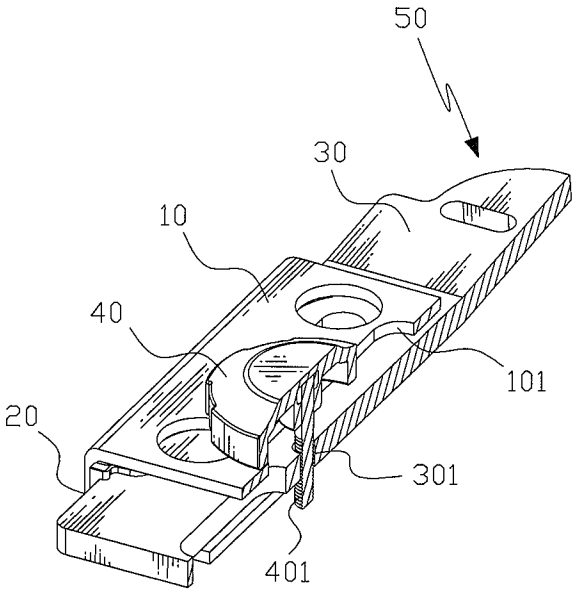
FIG. 1-1 PRIOR ART
FIG. 1 is a perspective view showing the assembly of a conventional adjusting assembly of two armrests for a chair.
Figure 1:
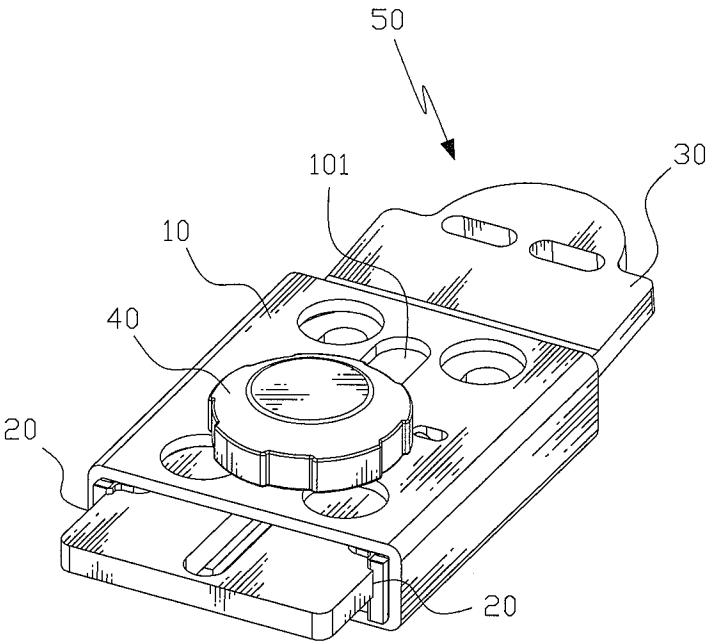
FIG. 1 PRIOR ART
Figures 2, 4:
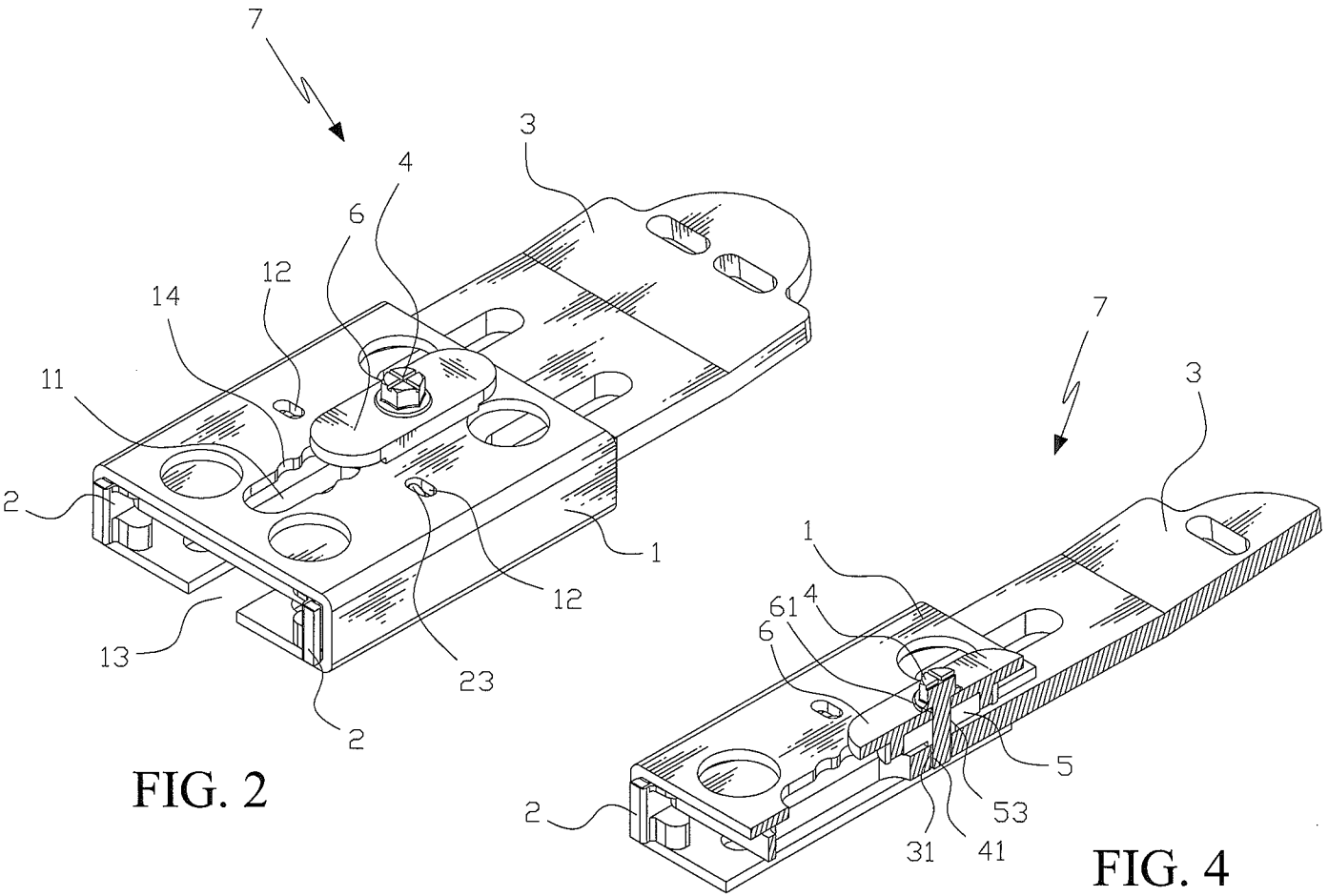
FIG. 2 is a perspective view showing the assembly of an adjustable armrest structure for a chair according to a preferred embodiment of the present invention.
FIG. 4 is a perspective view showing the cross section of the assembly of the adjustable armrest structure for the chair according to the preferred embodiment of the present invention.
Figure 3:
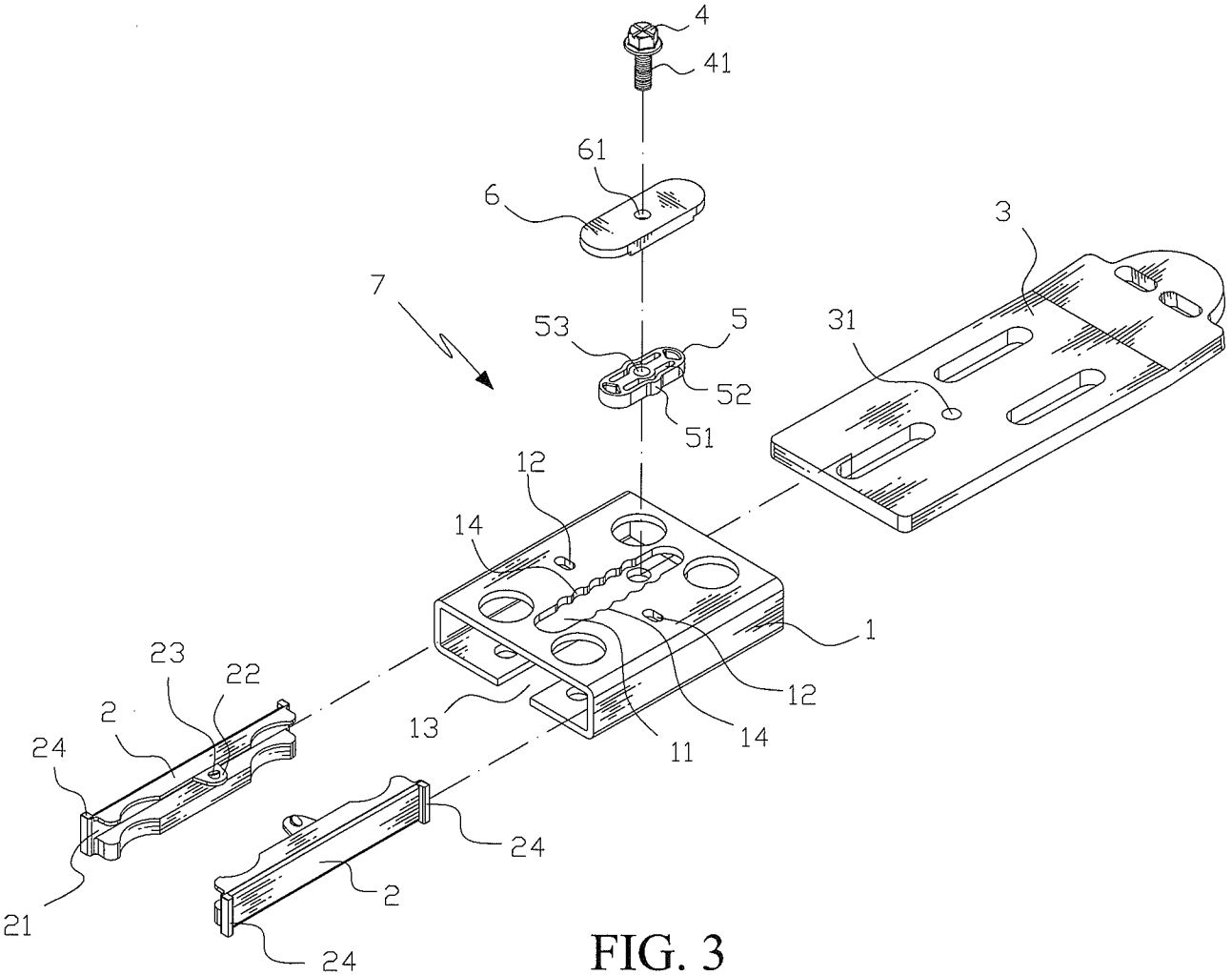
FIG. 3 is a perspective view showing the exploded components of the adjustable armrest structure for the chair according to the preferred embodiment of the present invention.

With reference to FIGS. 2 and 3, an adjustable armrest structure for a chair in accordance with a preferred embodiment of the present invention is an adjusting assembly 7 fixed to bottom ends of two armrests on two sides of the chair and including a body 1, two side rails 2, a movable member 3, and a screwing element 4.

The body 1, with a predetermined width, is hollow and includes a guiding slot 11 formed on a bottom end thereof. The guiding slot 11 includes two holes 12 arranged on two sides thereof respectively. The body 1 also includes a horizontally spaced distance 13 disposed on a top end thereof, so that the armrest is guided to move.

The side rail 2 is formed based on a height and a depth of an exterior of the body 1. The side rail 2 includes a space 21 mounted on one side thereof, includes a tab 22 extending outward from the one side thereof, and includes a boss 23 fixed on a top end of the tab 22. When the side rail 2 is fitted into the body 1, the boss 23 is retained with the hole 12 correspondingly. The side rail 2 also includes two locking sections 24 attached on front and rear ends thereof individually to abut against the body 1 when the side rail 2 engages with the body 1.

The movable member 3 is formed based on a height of the space 21 of the side rail 2 to be fitted between the side rails 2 to be further connected with the armrest, and includes an aperture 31 disposed thereon.

The screwing element 4 is inserted through the guiding slot 11 of the body 1 and screwed with the aperture 31 of the movable member 3 which is fitted to the body 1.

The guiding slot 11 of the body 1 includes a plurality of arcuate recesses 14 (as shown in FIG. 3) arranged around the two sides thereof to fit two projections 51 which are fixed on two sides of a guide member 5 respectively. The guide member 5 is integrally made of plastic material and includes at least one hollow spaced room 52 formed thereon. An actuating member 6 includes a bore 61 disposed thereon and is fixed to the guide member 5. The actuating member 6 is made of plastic material in this embodiment. The screwing element 4 is inserted through the bore 61 of the actuating member 6 and an orifice 53 of the guide member 5. A screw segment 41 of the screwing element 4 is screwed with the aperture 31 of the movable member 3 (as illustrated in FIG. 4).

Figure 5:
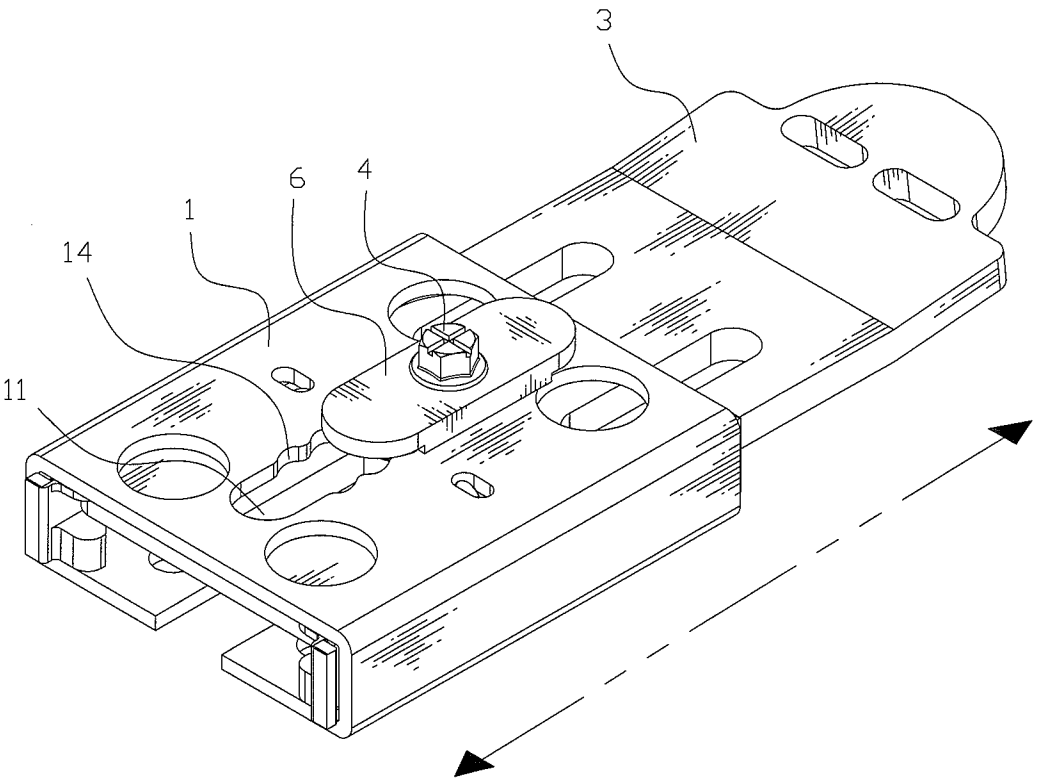
FIG. 5 is a perspective view showing the operation of the adjustable armrest structure for the chair according to the preferred embodiment of the present invention.

In operation, as shown in FIG. 5, the actuating member 6 of the adjusting assembly 7 is held by a hand to be moved inward or outward along the guiding slot 11 of the body 1 to actuate the guide member 5 to move along the arcuate recesses 14 resiliently and smoothly. The movable member 3 is moved to a predetermined position to engage with the armrest of the chair securely without being moved by an external force.

While various embodiments in accordance with the present invention have been shown and described, it is clear to those skilled in the art that further embodiments may be made without departing from the scope of the present invention.

What is claimed is:

1. An adjustable armrest structure for a chair comprising an adjusting assembly fixed to bottom ends of two armrests on two sides of the chair and including a body, two side rails to be fitted to and engaged with the body, a movable member configured to be attached to the bottom ends of the two armrests, the movable member fitted between the side rails for movement in a first plane, a guide member and an actuating member, with the body including a guiding slot in a second plane parallel to the first plane, the guiding slot formed on a bottom end of the body and having a screwing element received therethrough, with the screwing element engaging with the movable member; wherein the guiding slot of the body includes a plurality of arcuate recesses arranged along two sides thereof, wherein two projections are fixed on two sides of the guide member respectively, wherein the actuating member includes a bore disposed thereon and is fixed to the guide member, wherein the screwing element is inserted through the bore of the actuating member and an orifice of the guide member, with the screwing element passing through the bore of the guide member intermediate the two projections, with the guide member located within and moveable in the second plane along the guiding slot, with the two projections moveable generally perpendicular toward and away from the screwing element, and wherein a screw segment of the screwing element is screwed with an aperture of the movable member, wherein the two projections move along the plurality of arcuate recesses resiliently when the actuating member is moved parallel to the guiding slot.

2. The adjustable armrest structure for the chair as claimed in claim 1, wherein the guide member is integrally made of plastic material and includes at least one hollow spaced room formed thereon, wherein the two projections of the guide member are actuated to move along the arcuate recesses resiliently.

3. The adjustable armrest structure for the chair as claimed in claim 1, wherein the actuating member is made of plastic material.

* * * * *